US005173972A

United States Patent [19]

Goodman

[11] Patent Number: 5,173,972

[45] Date of Patent: Dec. 29, 1992

[54] AUTOMATIC FOOT WASHER

[76] Inventor: John D. Goodman, 1094 Pinehurst Trail, Grayson, Ga. 30221

[21] Appl. No.: 771,208

[22] Filed: Oct. 4, 1991

[51] Int. Cl.[5] ..... A47K 3/00

[52] U.S. Cl. ..... 4/494; 4/615; 239/543; 239/578

[58] Field of Search ..... 4/494, 496, 615, 616, 4/617, 622, 597, 605; 128/365, 366, 66, 368, 369, 370; 239/543, 545, 578; 251/295, 342

[56] References Cited

U.S. PATENT DOCUMENTS

| | | | |
|---|---|---|---|
| 2,267,169 | 12/1941 | Rast | 4/622 |
| 2,274,739 | 3/1942 | Rast | 4/622 |
| 2,654,894 | 10/1953 | Van Dijck | 4/615 |
| 2,665,171 | 1/1954 | Stievater | 239/543 X |
| 2,956,565 | 10/1960 | Anderson | 128/369 |
| 2,988,754 | 6/1961 | Misson | 4/622 |
| 3,144,003 | 8/1964 | Jacobs | 251/342 X |
| 3,292,185 | 12/1966 | Lucian | 4/615 |
| 3,292,614 | 12/1966 | Fleming | 128/57 |
| 3,536,294 | 10/1970 | Rodriguez | 251/295 X |
| 3,741,201 | 6/1973 | Oudkerk | 128/66 |
| 3,805,822 | 4/1974 | Joannon | 4/605 X |
| 3,881,471 | 5/1975 | Grube | 128/65 |
| 3,925,830 | 12/1975 | Delaney | 4/615 |
| 3,965,925 | 6/1976 | Gooch | 251/342 X |
| 3,973,286 | 8/1976 | Logan | 4/615 X |
| 4,099,522 | 7/1978 | Alenares | 128/370 X |
| 4,184,488 | 1/1980 | Bielich | 4/622 X |
| 4,485,503 | 12/1984 | Rolando et al. | 4/622 |
| 4,729,135 | 3/1988 | Titterington | 4/597 |
| 4,934,000 | 6/1990 | Freedman | 4/597 |

FOREIGN PATENT DOCUMENTS

| | | | |
|---|---|---|---|
| 0820796 | 4/1981 | U.S.S.R. | 4/597 |
| 0854364 | 8/1981 | U.S.S.R. | 4/597 |
| 1567179 | 5/1990 | U.S.S.R. | 4/605 |
| 0884648 | 12/1961 | United Kingdom | 4/616 |

OTHER PUBLICATIONS

Lonn Water Saver Marketing Information.

*Primary Examiner*—Henry J. Recla
*Assistant Examiner*—Robert M. Fetsuga
*Attorney, Agent, or Firm*—Louis T. Isaf

[57] ABSTRACT

An automatic foot washer for being located on a treadable surface and including, in its most preferred embodiment, a hollow frame structure which rests on the treadable surface, bounds a central open area, and defines both a hollow inner space and a plurality of spray outlets extending into the hollow inner space, a valve assembly which is connected to the hollow frame structure, extends into the hollow inner space, and includes both a supply connector for connection to a pressurized water source and a flexible valve hose, a grated actuating platform which is located within the central open area and rests partially on the treadable surface, and an actuator lever which is mounted to the actuator platform and operatively contacts the flexible valve hose to, when a person steps on the actuator platform, open the valve assembly and establish communication of the pressurized water source with the hollow inner space and the plurality of spray outlets to spray water through the plurality of spray holes over the grated actuating platform and onto a person's feet, ankles, and calves.

24 Claims, 4 Drawing Sheets

AUTOMATIC FOOT WASHER

BACKGROUND OF THE INVENTION

The present invention relates generally to the field of applying liquid to feet, and, in its most preferred embodiments, to the field of automatic foot washers.

Contrary to the desires of many small children, it is very well known that sand, grass clippings, dirt, and other types of debris do not belong in swimming pools. In efforts to keep swimming pools clean, owners have, in the past, installed showers or other water outlets to be used by people before entering swimming pools. Yet many people of all ages have aversions to utilizing these manual devices. In beach environments, sandy feet are typically the only impediments to entering swimming pools, and many people simply disregard the pool rules pertaining to these shower devices and jump right into the pool with sand on their feet. The common results are dirty swimming pools and clogged swimming pool filters. There is a need for an automatic foot washer which is readily adaptable to swimming pool environments, especially those adjacent to beaches.

U.S. Pat. No. 3,925,830, issued to Delaney, discloses a foot shower and spray device for washing feet preparatory to entering a swimming pool. The Delaney device includes a sloped, solid actuating platform which is spring mounted upon a base, two shower heads connected to the base and located above the actuating platform, a fitting attachment connected to the base for the attachment of a garden hose, and a valve assembly located within the base for communicating water supplied from the garden hose to the shower heads when a person steps onto the actuating platform.

The shower heads of the Delaney device are attached to pipes which obtrusively extend upward along the outside of the device. The specially shaped actuating platform and base, the various mechanical elements, including the various springs, lever, and spring valve assembly, and the extensive water directing network, appear to contribute to an overall design which is far from simple, durable, or inexpensive.

U.S Pat. No. 2,267,169, issued to Rast, is directed to a device for applying medicinal liquid to feet. The Rast device includes a slatted actuating platform which is spring mounted upon a base which includes a tank filled with medicinal liquid which is manually replenished through a connected filling spout and dispersed through spray pumps located below the actuating platform which spray the liquid upward through the actuating platform onto the soles of feet. Rather than being easy to use, a user must swing his body in a wobbly motion to encourage the Rast device to deliver more than a brief spray of liquid. The Rast device is not equipped to be attached to a pressurized water source, does not apply liquid to the tops of feet or in continuous streams, and appears to be rather complicated in design and construction.

There is a need, therefore, for an automatic foot washer for location near a swimming pool which is efficient, non-obtrusive, simple in construction, durable, inexpensive, and easy to use.

SUMMARY OF THE INVENTION

Briefly described, the present invention, in its most preferred embodiment, includes an automatic foot washer for being located on a treadable surface, such as a concrete surface near a swimming pool. The present invention includes a hollow frame structure which rests on the treadable surface, bounds a central open area, and defines a hollow inner space and a plurality of spray outlets extending into the hollow inner space. The present invention also includes a valve assembly which is connected to the hollow frame structure, extends into the hollow inner space, and includes both a supply connector for connection to a pressurized water source and a flexible valve hose for extending into the hollow inner space. The present invention further includes a grated actuating platform which is located within the central open area and rests partially on the treadable surface. An actuator lever is mounted to the actuator platform and operatively contacts the flexible valve hose to, when a person steps on the actuator platform, open the valve assembly and establish communication of the pressurized water source with the hollow inner space and the plurality of spray outlets to spray water through the plurality of spray outlets over the grated actuating platform and onto a person's feet, ankles, and calves.

It is, therefore, an object of the present invention to provide an automatic foot washer which is efficient, non-obtrusive, simple in construction, durable, inexpensive, and easy to use.

Another object of the present invention is to provide an automatic foot washer for location on a treadable surface which includes a frame structure bounding a central open area which rests on the treadable surface and a grated actuator platform which rests partially upon the treadable surface.

Yet another embodiment of the present invention is to provide an automatic foot washer which includes a hollow frame structure which defines a hollow inner space and a plurality of spray outlets extending through the hollow frame structure into the hollow inner space.

Still another object of the present invention is to provide an automatic foot washer which includes a valve assembly which includes a flexible valve hose which, when deformed, opens the valve assembly to carry water and which also provides resilient force sufficient to move an actuator lever and actuator platform back to an original position after weight is removed from the actuator platform, thus enabling the valve assembly to close.

Still another object of the present invention is to provide an automatic foot washer which includes a hollow frame structure which serves both as a frame structure and as pipes and spray devices in a water distribution network.

Still another object of the present invention is to provide an automatic foot washer which includes a valve assembly in which the moving valve components are located completely within the water passage.

Still another object of the present invention is to provide an automatic foot washer which includes a valve assembly which is closed by pressure from a pressurized water supply.

Still another object of the present invention is to provide an automatic foot washer which includes spray outlets with spray passages whose locations and orientations cause emitted water streams to collide and produce fan spray patterns.

Still another object of the present invention is to provide an automatic foot washer which includes a base with a valve slot, a valve assembly connected to the base, an actuator platform, and an actuator lever which extends from the actuator platform through the valve slot to operatively contact the valve assembly.

Still another object of the present invention is to provide an automatic foot washer which includes a hollow frame structure composed of pipes and pipe joints which connect the pipes and elevate the pipes to allow efficient draining underneath.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
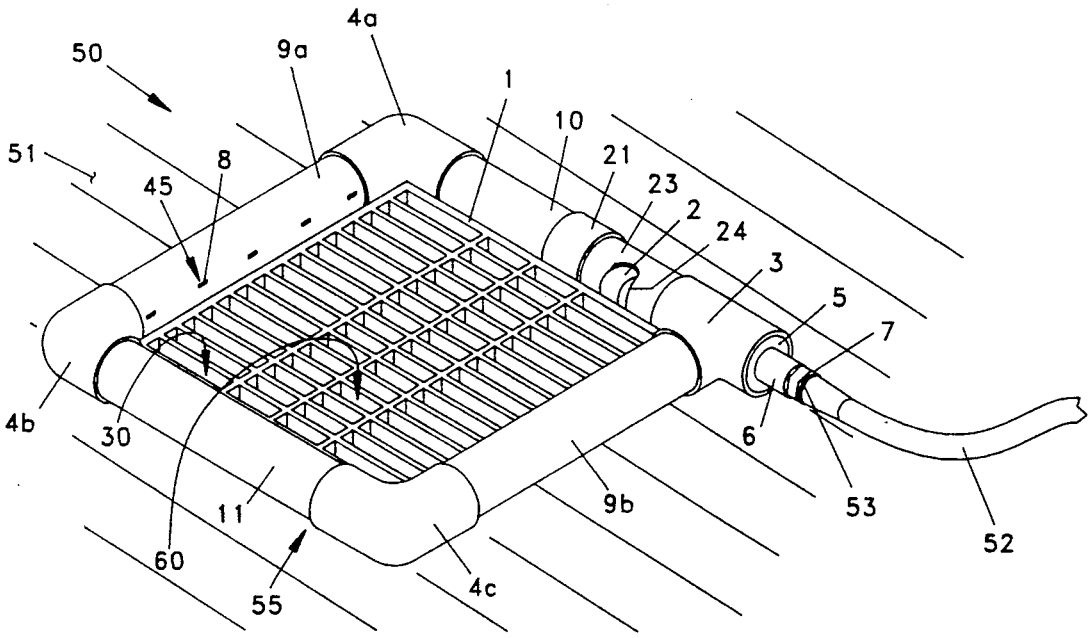
FIG. 1 is a perspective view of an Automatic Foot Washer in accordance with the preferred embodiment of the present invention.

Referring now in greater detail to the drawings, in which like numerals represent like components throughout the several views, an Automatic Foot Washer 50 is shown in FIG. 1 in a perspective view in accordance with a preferred embodiment of the present invention. The automatic foot washer 50 is resting on a treadable surface 51 and is connected to a pressurized water source (not shown) through a supply hose 52 and supply hose coupling 53. The automatic foot washer 50 includes a distribution means in the form of a hollow frame structure 55 bounding or circumscribing a central open area 60, which is shown occupied by an actuating platform means int he form of a grated actuator platform 1.

Figure 2:
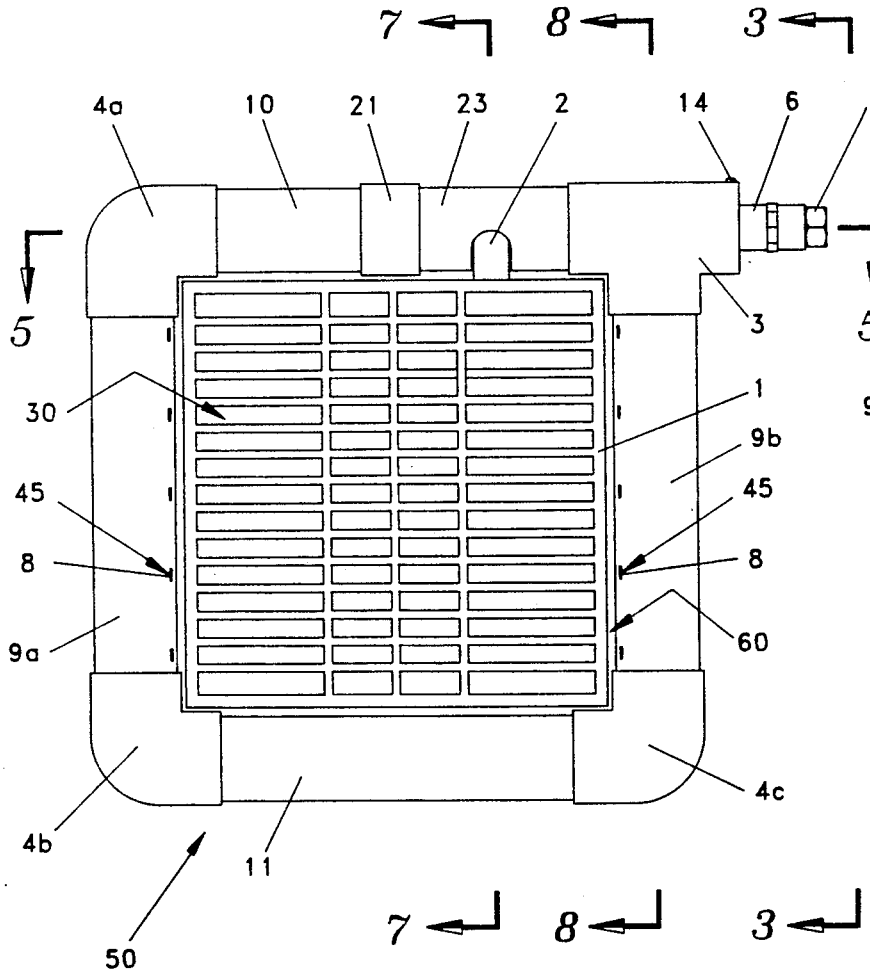
FIG. 2 is a top plan view of the preferred embodiment of the present invention.

In the preferred embodiment, the automatic foot washer 50 includes a tee fitting 3, a valve shelter pipe 23 connected to the tee fitting 3, a pipe coupling connecting a header pipe 10 to the valve shelter pipe 23, an elbow fitting 4*a* connecting a spray pipe 9*a* to the header pipe 10, an elbow fitting 4*b* connecting a cross-over pipe 11 to the spray pipe 9*a*, an elbow fitting 4*c* connecting a spray pipe 9*b*, which is also connected to the tee fitting 3, to the cross-over pipe 11. The tee and elbow fittings 3, 4 are seen to define outer diameters which are slightly larger than the outer diameters of the pipes 23, 10, 9, 11, thus slightly elevating same. Five devices in the form of spray outlets 45, each having a spray guide slot 8, are located in each spray pipe 9*a*, 9*b* (FIG. 2 shows the spray outlets 45 in spray pipe 9*b*). An actuator slot 24 extends into the valve shelter pipe 23.

The supply hose coupling 53 of the supply hose 52 is shown removably connected to a hose-to-pipe adapter 7, which is connected to a female pipe fitting 6, which abuts a support interface 5, which is connected to the tee fitting 3. The grated actuator platform 1 includes multiple platform apertures 30 and rests partially on the treadable surface 51. An actuating means in the form of an actuator lever 2 is mounted through screws (not seen) to the actuator platform 1 and extends through the actuator slot 24. In alternative embodiments of the present invention, the actuator lever 2 and actuating platform 1 are formed in a unitary construction as would be understood by one reasonably skilled in the art.

Figure 3:
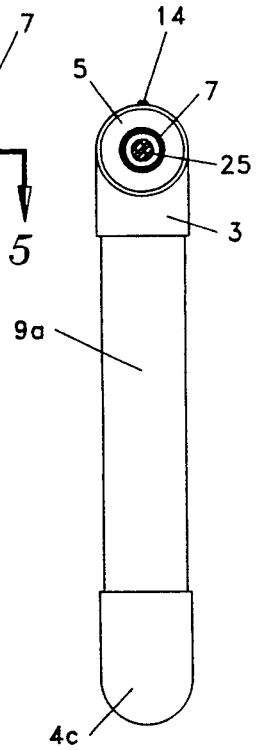
FIG. 3 is a side elevational view of the preferred embodiment of the present invention taken along line 3—3 of FIG. 2.
Figure 4:
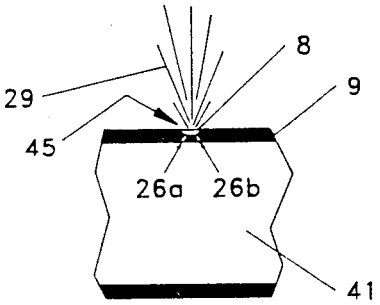
FIG. 4 is a detailed cross-sectional view of a spray outlet of the preferred embodiment of the present invention.

FIG. 2 is a top plan view of the automatic foot washer 50 in accordance with the preferred embodiment of the present invention. A retaining screw 14 is shown extending into the tee fitting 3 to securely mount the support interface 5 (shown in FIG. 1). FIG. 3 is a side elevational view of the automatic foot washer 50 of the preferred embodiment taken along line 3—3 of FIG. 2. Located inside the hose-to-pipe adapter 7 is a filter screen 25. FIG. 4 is a detailed cross-sectional view of one of the spray outlets 45. Each spray outlet 45 includes a spray guide slot 8 and two spray passages 26*a*, 26*b* which extend through the spray pipe 9 and into a water cavity 41.

Figure 5:
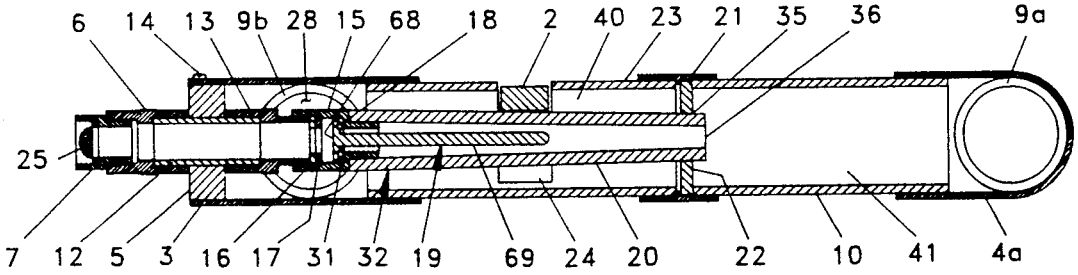
FIG. 5 is a side cross-sectional view of the preferred embodiment of the present invention taken along line 5—5 of FIG. 2.
Figure 6:
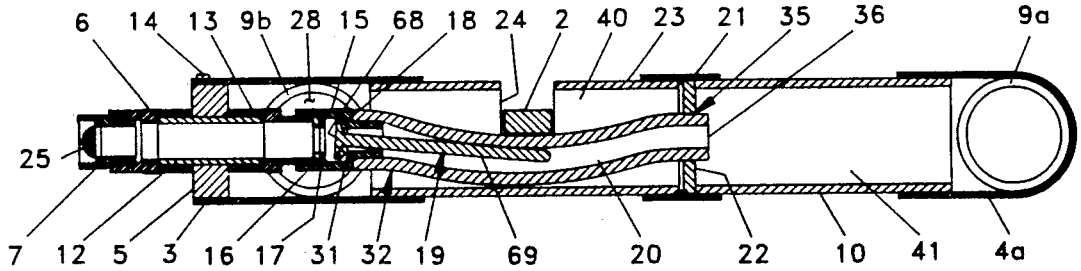
FIG. 6 is a side cross-sectional view of the preferred embodiment of the present invention taken along line 5—5 of FIG. 2 and shown in an actuated state.

FIGS. 5 and 6 are side cross-sectional views of the automatic foot washer 50 of the preferred embodiment taken along line 5—5 of FIG. 2. FIG. 5 shows the automatic foot washer 50 in a normal, resting state, and FIG. 6 shows the automatic foot washer 50 in an actuated state. Referring also to FIG. 1, the water cavity 41 begins at an entry bulkhead 22, extends through the header pipe 10, the elbow fitting 4*a*, the spray pipe 9*a*, the elbow fitting 4*b*, the cross-over pipe 11, the elbow fitting 4*c*, and the spray pipe 9*b*, and terminates at a pressure bulkhead 28.

The female pipe fitting 6 is shown connected to one end of a feed-through pipe 12 which extends through an opening in the support interface 5. A male pipe fitting 13 is connected to the other end of the feedthrough pipe 12. A valve body 15 of a valve means such as the valve 32 is shown connected to the male pipe fitting 13. Interposed between the male pipe fitting 13 and the valve body 15 is a connector seal 16. A valve retainer 17 is shown located inside the valve body 15 adjacent the connector seal 16. The valve body 15 also includes a valve shoulder 31 against which a valve element 19 of the valve 32 is normally biased. The valve element 19 consists of an element head 68 and an element tail 69. Interposed between the element head 68 and the valve shoulder 31 and connected to the element head 68 is a valve seal 18. A valve hose 20 of the valve 32 is connected to the valve body 15 and extends through a valve cavity 40, which is defined by the valve shelter pipe 23 and the tee fitting 3, and through the entry bulkhead 22 into the water cavity 41. The element tail 69 extends through the valve hose 20, which is shown being contacted by the actuator lever 2 as it extends through the actuator slot 24.

Figure 7:
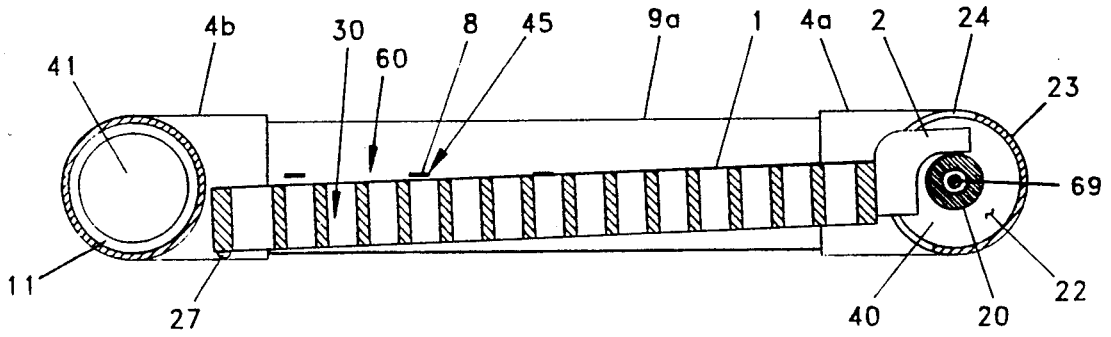
FIG. 7 is a side cross-sectional view of the preferred embodiment of the present invention taken along line 7—7 of FIG. 2.

FIG. 7 is a side cross-sectional view of the automatic foot washer 50 of the preferred embodiment taken along line 7—7 of FIG. 2. A platform foot 27 is shown attached to one corner of the actuator platform 1 adjacent to the elbow fitting 4*b*. Another platform foot 27 (not shown) is attached to the platform 1 at a location adjacent the elbow fitting 4c. The platform 1, located within the central open area 60, is shown resting at an angle between the platform foot 27, which normally contacts the treadable surface 51 (shown in FIG. 1), and connection with the valve hose 20 through the actuator lever 2, which extends through the actuator slot 24 and into the valve cavity 40. The element tail 69 is shown inside the valve hose 20, which extends through the entry bulkhead 22.

Figure 8:
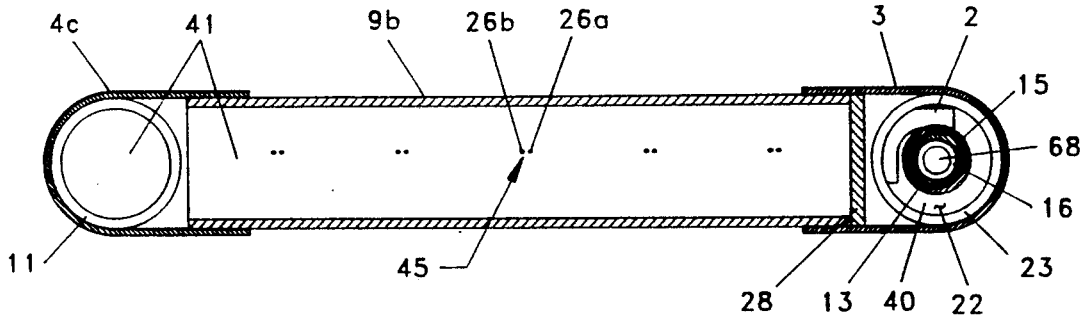
FIG. 8 is a side cross-sectional view of the preferred embodiment of the present invention taken along line 8—8 of FIG. 2.

FIG. 8 is a side cross-sectional view of the automatic foot washer 50 of the preferred embodiment taken along line 8—8 of FIG. 2. The spray passages 26*a*, 26*b* of the spray outlets 45 are shown in spray pipe 9*b*. The actuator lever 2 is shown extending into the valve cavity 40. Inside the tee fitting 3, the valve body 15 is shown encircling the male pipe fitting 13 in front of the connector seal 16, which is also in front of the element head 68. The end of the valve shelter pipe 23 is also shown in front of the entry bulkhead 22. A side cross-sectional view of the pressure bulkhead 28 is also shown.

Referring back to FIGS. 1 and 5, in the normal, resting state, the valve 32 is closed and the automatic foot washer 50 does not spray any water through the spray outlets 45. As water enters the automatic foot washer 50, filter screen 25 prevents debris from entering the hose-to-pipe adapter 7. Pressurized water normally occupies the hose-to-pipe adapter 7, the female pipe fitting 6, the feed-through pipe 12, the male pipe fitting 13, and a portion of the valve body 15. The connector seal 16 prevents leaks between the male pipe fitting 13 and the valve body 15, and the valve retainer 17 prevents the valve element 19 from falling backwards through the valve body 15 when the valve 32 is detached from the present invention. Water pressure normally biases the element head 68 and valve seal 18 against the valve shoulder 31 to cause the valve seal 18 to seat and prevent water from freely entering the valve hose 20. When no external weight is applied to the actuator platform 1, the resilience of the valve hose 20 normally supports the actuator lever 2, (and actuator platform 1) as shown in FIG. 5.

Referring now to FIGS. 1 and 6, as a person steps onto the actuator platform 1, the actuator lever 2 deforms the valve hose 20 as shown in FIG. 6. In this actuated state, the valve hose 20, because of the actuator lever 2, moves the element tail 69 to unseat the valve seal 18 and open the valve 32. Water then flows through the valve hose 20, which extends through the entry bulkhead 22, and into the water cavity 41 beginning inside the header pipe 10. The water level inside the water cavity 41 grows until it fills the water cavity 41. The water pressure then forces water to spray through the spray outlets 45 into the central open area 60 and onto the user's feet, ankles, and calves.

Referring also to FIG. 4, the water streams through the spray outlets 45 in a water spray 29 having a fan spray pattern. Each spray passage 26*a* is so located and oriented relative to the other spray passage 26*b* that the emitted water streams collide to produce a water spray 29 in a fan spray pattern emitted from each spray outlet 45. The spray guide slot 8 also cooperates in this fan spray production. As all of the spray outlets 45 emit these water sprays 29 in fan spray patterns, the user's feet, ankles, and calves are efficiently washed.

The water and sand, and/or other debris, then flow off of the user and downward through the platform apertures 30 of the actuating platform 1. Most of any of this mixture which may happen to splash into the valve shelter pipe 23 through the actuator slot 24 will drain out through the bottom of the actuator slot 24. Due in part to the close valve construction and sparcity of moving parts of the present invention, sand from users has little effect on the continued operation of the present invention. The mixture will then flow over the treadable surface 51, under the actuator platform 1, and under one or more of the pipes 10, 9*a*, 9*b*, 11, 23, because of the slight elevation resulting from the greater diameters of the fittings 3, 4, as discussed above.

Water flow will continue until the user steps off of the actuator platform. The resilience of the valve hose 20 will then force the actuator lever 2, and thus the actuator platform 1, back to their original, resting positions, as shown in FIG. 5. Water pressure will also move the valve element 19 to re-seat the valve seal 18 and close the valve 32, thus stopping the flow of water through the spray outlets 45.

It should be understood that the scope of the present invention also includes alternate embodiments defined by one or more variations of the preferred embodiment of the present invention. In the preferred embodiment of the present invention, the hollow frame structure 55 includes rigid pipes and fittings. One example of an acceptable construction media is the common conduit material referred to as PVC. In other embodiments, alternate materials are used, including flexible hose materials, to form a molded, unitary structure. In an alternate of this embodiment, feet or elevating pads are attached to or formed as part of the unitary structure.

Other alternate embodiments include alternate spray outlets consisting of single holes or complex spraying heads. Still other embodiments include an alternate frame structure and a separate network of distribution tubes mounted to the frame structure. Some of those embodiments include spray passages defined by the distribution tubes themselves, and others include spray nozzles connected to the distribution tubes. In still others of those embodiments, the alternate frame structures are solid and the distribution tubes are externally mounted thereto, yet in other embodiments, the frame structures are hollow, and the distribution tubes are mounted internally therein.

In the preferred embodiment of the present invention, one example of an acceptable valve 32 is the Lonn Water Saver available from Lonn Manufacturing Co., Inc., of Indianapolis, Ind. In alternate embodiments of the present invention, alternate valves and actuator levers are utilized to accomplish similar functions.

In addition, other alternate embodiments of the present invention do not include the valve shelter pipe 23, the hose-to-pipe fitting 6, the female pipe fitting 6, the support interface 5, the feed-through pipe 12, or the male pipe fitting 13, but include a brace for attaching the valve body 15 to the hollow frame structure 55. In that embodiment, the filter screen 25 is located within the valve body 15, and the supply hose 52 is connected directly to the valve body 15. In other embodiment, the actuator slot 24 is larger, extending further under the valve shelter pipe 23, and in other embodiments, drainage holes are formed into the valve shelter pipe 23. In other alternate embodiments of the present invention, the actuator lever 2 is attached to the actuator platform 1 through a unitary molding method, gluing, or other mounting methods. More than two platform feet 27 are also contemplated to be within the scope of the present invention.

While the embodiments of the present invention which have been disclosed herein are the preferred forms, other embodiments of the apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that the relative dimensions and relationships shown on the drawings are given as the preferred relative dimensions and relationships, but the scope of the invention is not to be limited thereby.

I claim:

1. An apparatus for directing water from a pressurized water source onto feet, said apparatus comprising:

a frame distribution structure at least partially bounding a central open area and defining a hollow inner space, and a plurality of spray passages communicating between said central open area and said hollow inner space;

a valve assembly connected to said frame distribution structure, said valve assembly including, at least, a supply connector adapted for connection to a pressurized water source, a flexible hose member connected to supply adapter to communicate with said pressurized water source and further communicating with said hollow inner space, and a valve element located at least partially within said flexible hose member;

an actuating platform located within said central open area; and an actuator lever mounted to said actuating platform and operatively contacting said flexible hose member to, when a person steps on said actuator platform, move said valve element to open said valve assembly and establish communication of said pressurized water source with said hollow inner space and said plurality of spray passages to spray water through said plurality of spray passages over said actuating platform and onto a person's feet.

2. Apparatus of claim 1, wherein said actuating platform is a grated platform.

3. Apparatus of claim 1, wherein said frame distribution structure includes, at least, a plurality of cylindrical pipes and a plurality of pipe joints connecting said cylindrical pipes into a square outline.

4. Apparatus of claim 3, wherein said plurality of pipe joints provide means for slightly elevating said plurality of cylindrical pipes to allow drainage below said frame distribution structure.

5. Apparatus of claim 1, wherein said plurality of spray passages extend through said frame distribution structure in pairs, each spray passage of each pair of spray passages extending through said frame distribution structure in such a location and at such an angle relative to the other spray passage of each pair to cause collisions between water streams emitted from each pair of spray passages.

6. Apparatus of claim 1, wherein said frame distribution structure further defines a hollow valve space at least partially surrounding at least part of said valve assembly, and an actuator slot extending through said frame distribution structure into said hollow valve space, said actuator lever extending through said actuator slot.

7. Apparatus of claim 1, wherein said frame distribution structure includes, at least, a first bulkhead defining one end of said hollow inner space and defining a passage for receiving said flexible hose member.

8. Apparatus of claim 1, wherein said flexible hose member is resilient and provides resilient force sufficient to move said actuator lever and said actuator platform back to an original position after weight is removed from said actuator platform.

9. Apparatus of claim 1, wherein said valve element is located entirely within said flexible hose and said supply connector.

10. Apparatus of claim 1, wherein said supply connector includes, at least, an inner shoulder, and force of water from said pressurized water source urges said valve element against said inner shoulder to close said valve assembly.

11. An apparatus for directing water from a pressurized water source onto feet, said apparatus comprising:

a frame distribution structure at least partially bounding a central open area and including, a least, a plurality of hollow cylindrical pipes having pipe walls;

a plurality of pipe joints connecting said plurality of pipes together and elevating said hollow cylindrical pipes, and two bulkhead disks located within said plurality of pipes to define a hollow inner space and a hollow valve space, said frame distribution structure defining a plurality of spray passages communicating between said central open area and said hollow inner space, said plurality of spray passages extending through said pipe walls in pairs, each spray passage of each pair of spray passages extending through a pipe wall in such a location and at such an angle relative to the other spray passage of each pair to cause collisions between water streams emitted from each pair of spray passages, and said frame distribution structure further defining an actuator slot extending through a pipe wall into said hollow valve space;

a valve assembly connected to said frame distribution structure and located, at least partially, within said hollow valve space, said valve assembly including, at least, a supply connector adapted for connection to a pressurized water source and including, at least, an inner shoulder, a flexible hose member connected to said supply adapter to communicate with said pressurized water source and connected through one of said bulkhead disks to communicate with said hollow inner space, said flexible hose member, and a valve element located entirely within said flexible hose member and said supply connector, said valve element being urged against said inner shoulder to close said valve assembly by force of water from said pressurized water source;

a grated actuating platform located within said central open area; and an actuator lever mounted to said actuating platform and operatively contacting said flexible hose member to, when a person steps on said actuator platform, move said valve element to open said valve assembly and establish communication of said pressurized water source with said hollow inner space and said plurality of spray passages to spray water through said plurality of spray passages over said grated actuating platform and onto a person's feet, said flexible hose member being resilient and providing resilient force sufficient to move said actuator lever and said actuator platform back to an original position after weight is removed from said actuator platform.

12. An apparatus for being located on a treadable surface for directing water from a pressurized water source onto feet, said apparatus comprising:

a distribution means at least substantially circumscribing a central open area for distributing water into said central open area;

a valve means for selectively communicating water from a pressurized water source to said perimeter distribution means;

an actuating platform located within said central open area and adapted to rest, at least partially, on the treadable surface, said platform being movably mounted with respect to said distribution means, said distribution means at least substantially circumscribing perimeter of said platform; and an actuator means interposed between said actuating platform and said valve means for, upon depression of said actuating platform, operating said valve means.

13. Apparatus of claim 12, wherein said perimeter distribution means defines a hollow inner space and a plurality of spray passages communicating between said central open space and said hollow inner space.

14. Apparatus of claim 12, wherein said valve means includes, at least, a supply connector adapted for connection to a pressurized water source, and a valve element for selectively blocking water flow.

15. Apparatus of claim 14, wherein said valve means further includes, at least, a flexible hose interposed between said supply connector and said distribution means, said valve element being located at least partially within said flexible hose.

16. Apparatus of claim 14, wherein said perimeter distribution means defines a hollow inner space and includes, at least, an entry bulkhead bordering one end of said hollow inner space, and wherein said valve means further includes, at least, an extension member connected to said supply connector, an interface assembly interposed between said extension member and said perimeter distribution means, a valve body connected to said extension member, said valve body including, at least, an inner shoulder, a flexible hose connected to said valve body and connected through said entry bulkhead to said hollow inner space, and wherein said valve element includes, at least, a head section located within said valve body and a tail section located, at least partially, within said flexible hose.

17. Apparatus of claim 12, wherein said actuator means includes, at least, an actuator lever mounted to said actuator platform, said actuator lever moving in a substantially vertical motion when said actuator platform is depressed.

18. An apparatus for being located on a treadable surface for directing water from a pressurized water source onto feet, said apparatus comprising:

a frame defining a central open area;

a distribution means associated with said frame and at least substantially circumscribing said central open area for distributing water into said central open area;

a valve means for selectively communicating water from a pressurized water source to said distribution means;

an actuating platform means located within said central open area and adapted to rest, at least partially, on the treadable surface, said platform means being movably mounted with respect to said distribution means such that depression of said actuating platform means operates said valve means, said distribution means at least substantially circumscribing a perimeter of said platform means.

19. Apparatus of claim 18, wherein said distribution means includes, at least, a tube network and a plurality of spraying devices.

20. Apparatus of claim 18, wherein said distribution means includes, at least, a tube network defining a plurality of spray apertures.

21. A foot washing apparatus comprising:

an actuating platform means including, at least, a movable platform member having a lever member mounted thereto for actuating a valve means;

a distribution means for distributing water onto said platform member; and a valve means for selectively communicating water from a pressurized water source to said distribution means, said valve means including, at least, a supply connector adapted for connection to a pressurized water source, a flexible hose member connected between said supply connector and said distribution means, and a valve element located at least partially within said flexible hose member, said lever member engaging said flexible hose member to open said valve means upon depression of said platform member.

22. Apparatus of claim 21, wherein said actuator is a unitary construction.

23. Apparatus of claim 21, wherein said distribution means includes, at least, a tube network and a plurality of spraying devices.

24. Apparatus of claim 21, wherein said distribution means includes, at least, a tube system defining a plurality of spray apertures.

* * * * *